US009193488B2

(12) United States Patent
Vaccari

(10) Patent No.: US 9,193,488 B2
(45) Date of Patent: Nov. 24, 2015

(54) MACHINE FOR PACKAGING PRODUCTS WITH STRETCHABLE AND HEAT-WELDABLE FILM

(75) Inventor: Massimiliano Vaccari, Reggio Emilia (IT)

(73) Assignee: GRUPPO FABBRI VIGNOLA S.p.A., Vignola (IT)

( * ) Notice: Subject to any disclaimer, the term of this patent is extended or adjusted under 35 U.S.C. 154(b) by 687 days.

(21) Appl. No.: 13/509,375

(22) PCT Filed: Nov. 15, 2010

(86) PCT No.: PCT/EP2010/067511

§ 371 (c)(1),
(2), (4) Date: May 11, 2012

(87) PCT Pub. No.: WO2011/061158

PCT Pub. Date: May 26, 2011

(65) Prior Publication Data

US 2012/0222393 A1 Sep. 6, 2012

(30) Foreign Application Priority Data

Nov. 18, 2009 (IT) ..... BO2009A0750

(51) Int. Cl.
*B65B 11/54* (2006.01)
*B65B 61/06* (2006.01)
(Continued)

(52) U.S. Cl.
CPC ..... *B65B 59/00* (2013.01); *B65B 11/54* (2013.01); *B65B 41/02* (2013.01); *B65B 2011/002* (2013.01)

(58) Field of Classification Search
CPC ..... B65B 53/02; B65B 53/063; B65B 11/54; B65B 61/06; B65B 41/04; B65B 41/14
USPC ..... 53/556, 557, 441, 466, 228–234, 389.3, 53/389.5
See application file for complete search history.

(56) References Cited

U.S. PATENT DOCUMENTS 5,157,903 A 10/1992 Nakashima et al.
5,595,042 A * 1/1997 Cappi et al. ..... 53/66
(Continued)

OTHER PUBLICATIONS

International Search Report for PCT/EP2010/067511 Dated Feb. 23, 2011.
(Continued)

*Primary Examiner* — Michelle Lopez
*Assistant Examiner* — Praachi M Pathak
(74) *Attorney, Agent, or Firm* — Marvin Petry; Stites & Harbison

(57) ABSTRACT

A machine with a packaging station, at which trays having products are sealed. Opposed parallel sets of belts move in synchronism with each other transversely to the direction of movement of the trays along the packaging station. Each set of belts has an upper belt and a lower belt adjacent to each other and moving in the same direction at the same speed. One end of the adjacent runs receives a sheet of film. A plurality of jaws are located on each of the opposed sets of belts, each set of jaws receiving adjacent runs and an edge of the film. The opposed sets of belts are moveable relatively towards and away from each other, such that the jaws can hold films of different widths and such that the film held therebetween can be stretched and relaxed. A clamp is connected to each set of jaws. The clamp is spring biased to the separate the top and bottom thereof. A power element exerts a selective force onto the bottom of the clamp to close the adjacent runs onto the film. Cams have profiles which, acting through levers, applies a closing force onto the jaws.

15 Claims, 4 Drawing Sheets

(51) Int. Cl.

| | |
|---|---|
| ***B65B 41/04*** | (2006.01) |
| ***B65B 41/14*** | (2006.01) |
| ***B65B 59/00*** | (2006.01) |
| ***B65B 41/02*** | (2006.01) |
| *B65B 11/00* | (2006.01) |

(56) References Cited

U.S. PATENT DOCUMENTS

| | | | | |
|---|---|---|---|---|
| 5,603,198 | A * | 2/1997 | Rimondi et al. | 53/441 |
| 5,855,106 | A * | 1/1999 | Koyama et al. | 53/556 |
| 6,189,302 | B1 * | 2/2001 | Kudo et al. | 53/556 |
| 7,152,388 | B2 | 12/2006 | Rimondi | |
| 2015/0191267 | A1 * | 7/2015 | Mochizuki | 53/373.2 |

OTHER PUBLICATIONS

Written Opinion of the International Searching Authority for for PCT/EP2010/067511 Dated Feb. 23, 2011.

* cited by examiner

MACHINE FOR PACKAGING PRODUCTS WITH STRETCHABLE AND HEAT-WELDABLE FILM

The invention relates to a packaging machine comprising means for unrolling sections of stretch film from a supply reel, separating said sections of film into lengths appropriate for the dimensions and the features of the product to be packaged, by transverse cutting, and positioning the sheet of film thus obtained, horizontally, in a packaging station, holding said sheet by the opposite longitudinal sides by means of parallel pairs of superposed, synchronized belts, one of the pairs being static while the other can move parallel thereto, so as to be able to hold films of different widths and to prestretch and apply the sheet of film during the packaging cycle. The product to be packaged is usually a fresh foodstuff, placed in a tray made of polystyrene or other suitable material. It will be referred to below simply as "product", this term also covering a group of such articles. The product to be packaged is raised against an intermediate zone of said sheet of stretch film, and in due course lateral folders take the edges of the film from one part of said pair of positioning belts and stretch them over the bottom of the tray. A rear folder is also activated in due course, to fold the rear edge of the sheet of film over or under said side edges, removing it completely from the pair of movable belts. Also in due course, a horizontal pusher above said rear folder comes into play and, as the product is held down by a presser, carries said product out of the packaging station, while the front edge of the packaging film is taken completely off the pair of static belts and stretched under the other edges by a front folder, which is usually fixed. The product leaving the packaging station lastly is conveyed by a conveyor that welds the lower, overlapped edges of the packaging film together, to secure the packaging.

These packaging machines are small, usually have means for controlling not only the size of the product to be packaged but also the weight thereof, and include, in the zone where the packaged product is discharged, a labeling unit for attaching one or more adhesive labels to the packaged product, providing information on the type of product, weight, price, date of packaging and/or expiry and/or other characteristics. Packaging machines of this type, described for example in U.S. Pat. No. 5,157,903 of 27 Oct. 1992 and in the corresponding Japanese priority document, have drawbacks particularly as regards the means that control how the longitudinal sides of the film are held by said pair of parallel conveyor belts and that, in the final cycle, weld the lower, overlapped edges of the packaging film. The first such drawback concerns the parallel, superposed sections of the pairs of film-positioning and -conveyor belts, specifically the fact that one of them, usually the upper one, runs under a fixed support surface while the lower one runs on the jaws of clamps connected to lifting or lowering means, for pushing the lower belt against the upper belt so as to grasp the film and hold it both while it is carried along and while the film is being folded under the tray containing the product. The jaws of the clamps are for example mounted on articulated-parallelogram oscillating means, connected via rods to the movable electromagnet apparatus. With this solution the clamps are activated non-selectively, with ON-OFF logic, so that the pressure for holding the film is either present or not, and when it is present it is equal and constant for all the clamps. This mode of operation is not satisfactory in that it has become apparent that it would be better if said opposing clamps exerted a moderate clamping action on the superposed belts as they convey the film to the packaging station, so as not to excessively force the motor driving these belts, among other reasons. However, said clamps must also tightly grip the film in the subsequent prestretching step in which the pair of movable belts is moved away from the pair of static belts, to prestretch the film transversely to the desired entity, by 100% or more, while during the final operation by the folders to stretch and overlap the edges of the film over the bottom of the tray, they need to release said film progressively, starting with the end clamps and ending with the central clamp, which should be the last to let go, at the end of each packaging cycle. The second drawback arises from the fact that, to limit the footprint of the machine, welding of the overlapped lower edges of the packaging film actually takes place while the package is moving, as it is about to be discharged from the packaging station, and therefore very quickly and unsatisfactorily, or with the packaged product at a standstill but after it has been conveyed at ninety degrees with respect to the movement out of the packaging station, with the result that the overlapped lower edges of the wrapping film may come apart before reaching the welding station.

The invention aims to overcome these drawbacks of the known prior art, with the solutions described in the attached claim 1 and the subsequent dependent claims, the features and advantages of which will be evident from the following description of a preferred embodiment thereof, illustrated purely by way of non-limiting example in the figures of the attached plates of drawings, in which:

Figure 1:
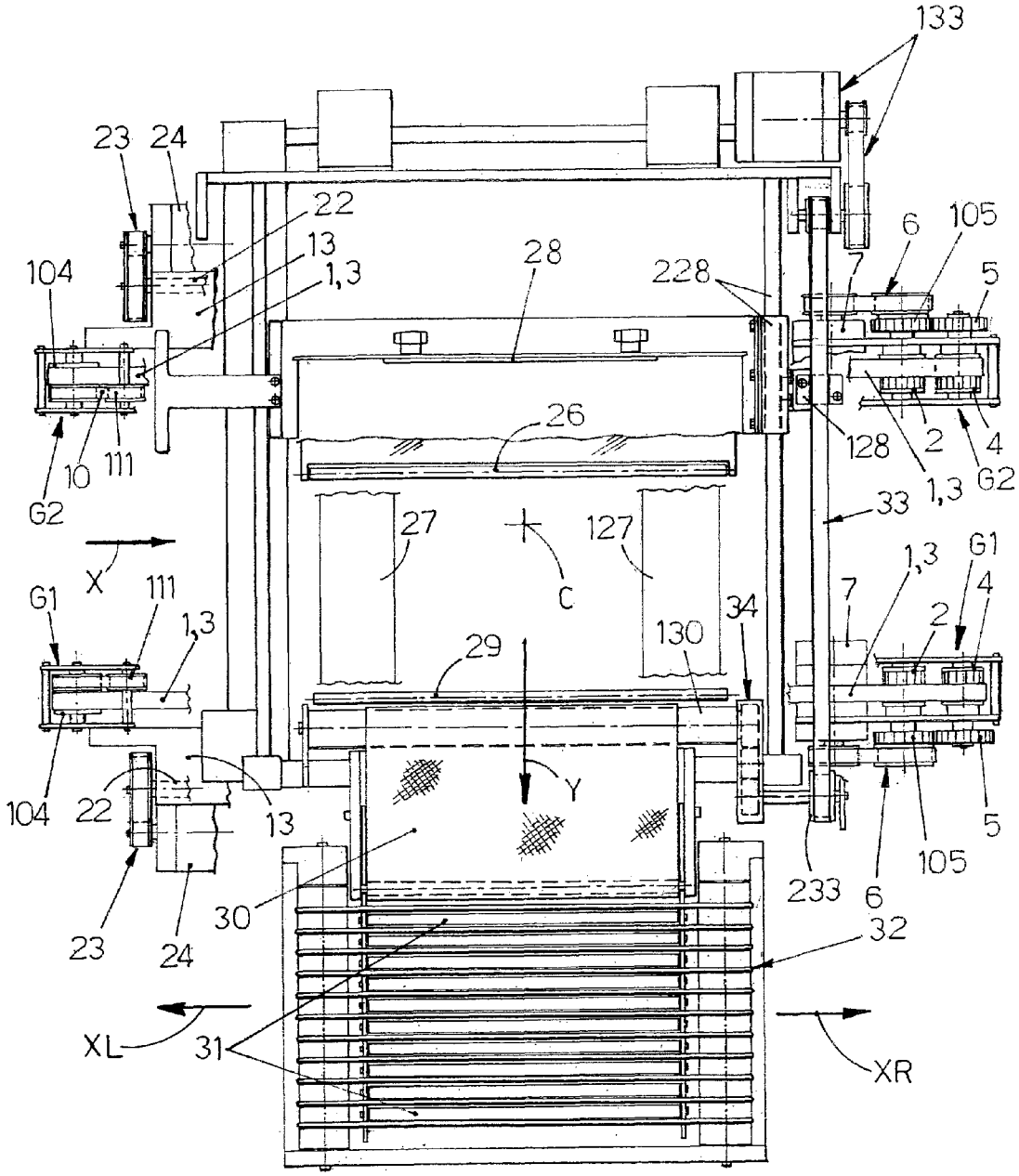
FIG. 1 is a schematic plan view of the main parts of the machine that operate in the packaging station and the areas around it.
Figures 2, 3:
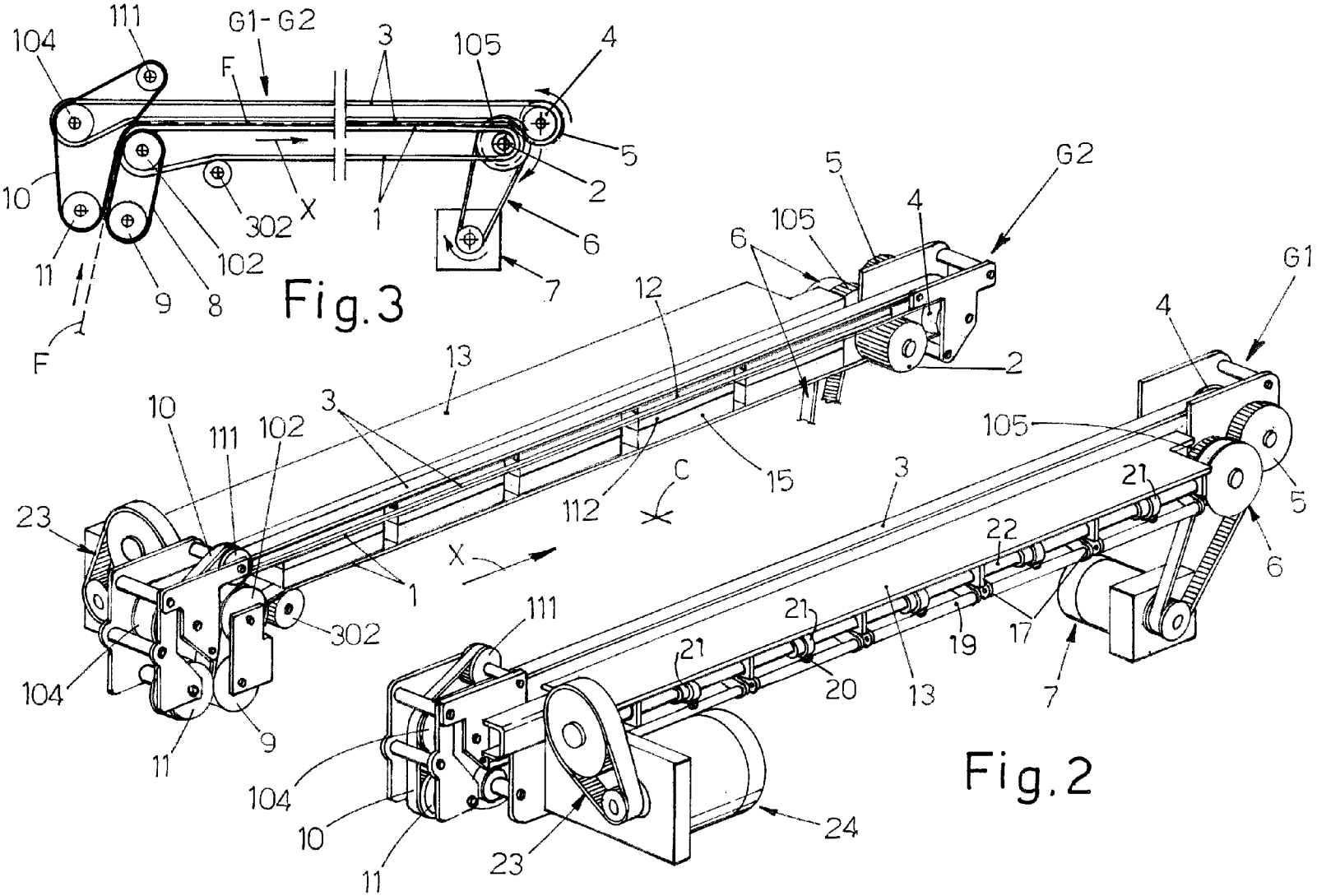
FIG. 2 is a perspective view of the two parallel pairs of superposed belts that supply the sheets of film in the packaging station.
FIG. 3 is a view in side elevation of one of the parallel pairs of superposed belts of FIG. 2, showing in particular the upstream means for supplying a sheet of film to said belts.

FIG. 1 shows the two parallel sets of pairs of horizontal superposed belts (referenced G1 and G2) that carry, in the direction marked by the arrow X, a sheet of film in the packaging station C of the machine. The set of belts G1 is parallel to and underlies the fixed front folder 29, and is also static, in the sense that its position on the machine is fixed, whereas the set of belts G2 is parallel to and underlies the movable rear folder 26 and is supported by known means (not shown). Said means can modify, on command, the distance between the set G2 and the set G1, while keeping the former parallel to the latter, according to the width of film supplied by the supply reel, as well as for the purposes of a step of transverse prestretching of the film (as applicable) and during the subsequent step of application of said film to the product to be packaged (see below). Each set of belts G1, G2 (FIGS. 1-3, 6) comprises a toothed lower belt 1 running around toothed end pulleys 2, 102 and controlled by at least one lower tensioner 302, and a toothed upper belt 3, longer than the belt 1 and running around toothed end pulleys 4, 104, in such a way that the lower section of said belt 3 is tensioned and in contact with the corresponding upper section of the lower belt 1. Intermeshing toothed wheels 5, 105 of equal diameter are fitted on the shafts bearing the end pulleys 2 and 4, and a positive drive transmission 6, for example with a belt and toothed pulleys, is connected to one of said shafts, said transmission being placed end to end with a drive unit 7 via which the superposed sections of the toothed belts 1 and 3 travel at equal speed in the direction X of advancement of the sheet of film F which, via the longitudinal sides thereof, is held between said superposed sections of the belts 1 and 3 of the parallel sets G1 and G2. The external surface of the toothed belts 1 and 3 is made of a material and has a degree of roughness such as to ensure an adequate grip on the film to be conveyed, while at the same time enabling said film to be extracted from said belts without being damaged during the final steps of the packaging cycle of the machine (see below).

Unlike the known solutions, whereby the belts 1 and 3 have an initial section inclined downwards, for receiving the sheet of film from the known unrolling and cutting means upstream, according to the invention said initial inclined section (FIGS. 2 and 3) is preferably formed by special belts, with a stronger grip than the belts 1 and 3, located on the inner face of the sets G1 and G2 and comprising a toothed belt 8 running around a pulley 9 and around an extension of the toothed pulley 102 and comprising, bearing on the upper section of said belt 8, a portion of the lower section of a belt 10 running around pulleys 11, 111 and around an extension of the toothed pulley 104.

Figure 4:
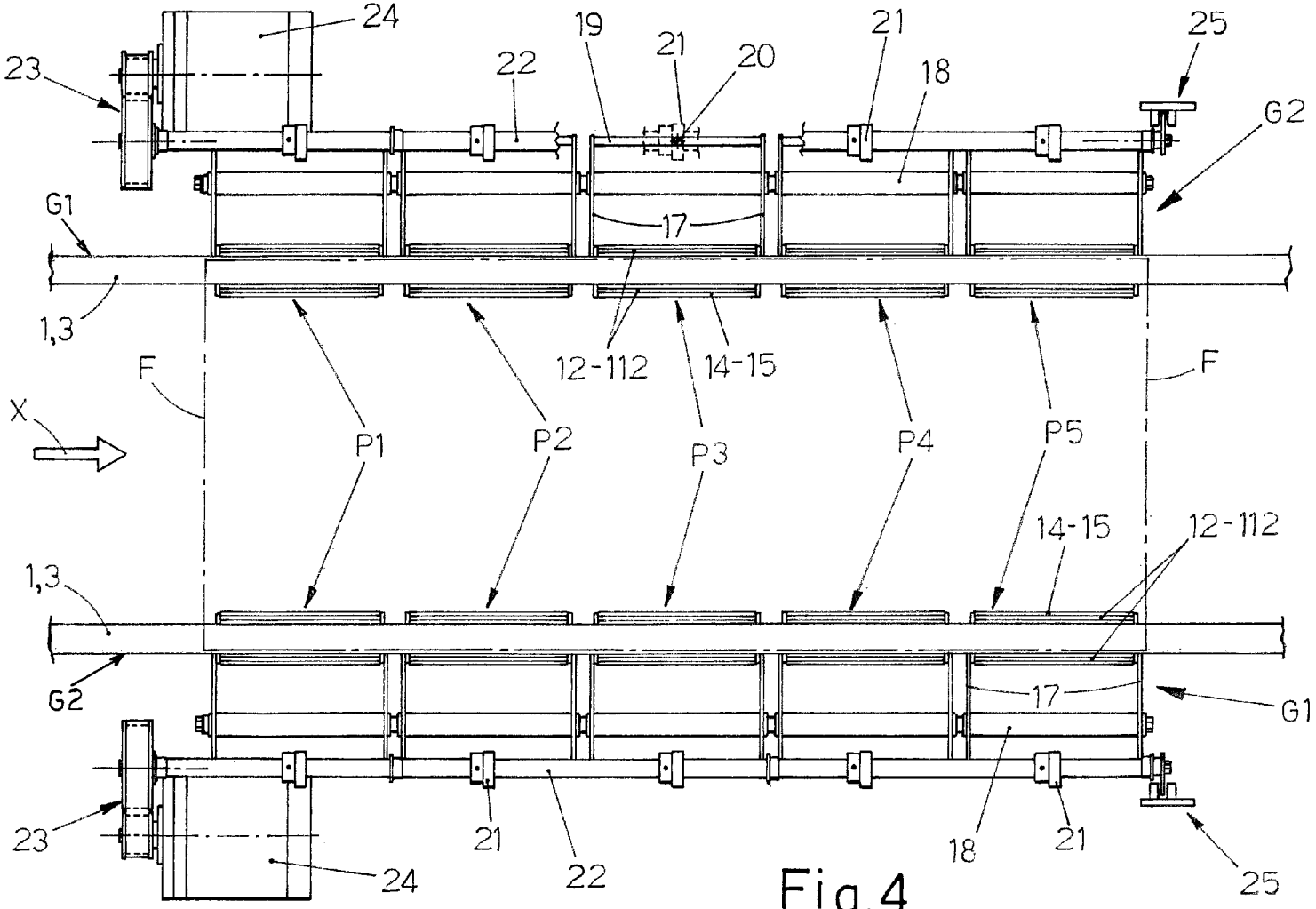
FIG. 4 is a schematic plan view from the top of the parallel pairs of superposed belts that convey a sheet of film in the packaging station, showing in particular the modulated-action clamps that act on said belts.
Figure 6:
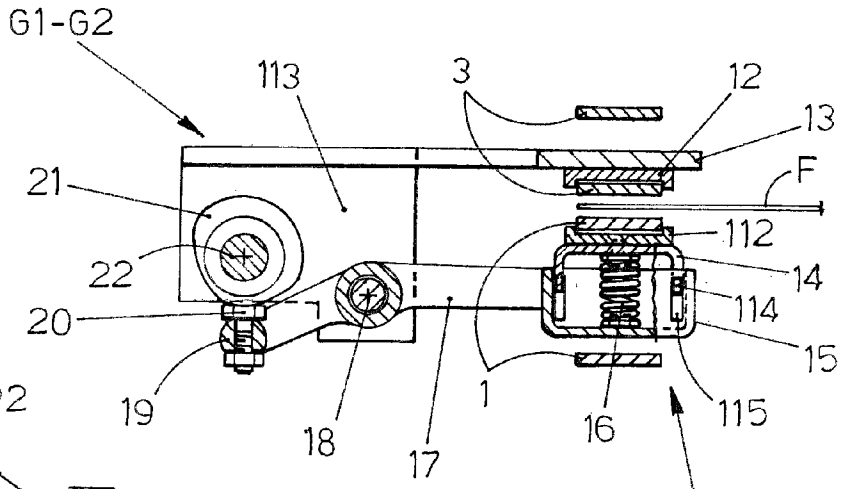
FIG. 6 shows the device of FIG. 5 in greater detail, with a cross section on the line VI-VI.
Figure 5:
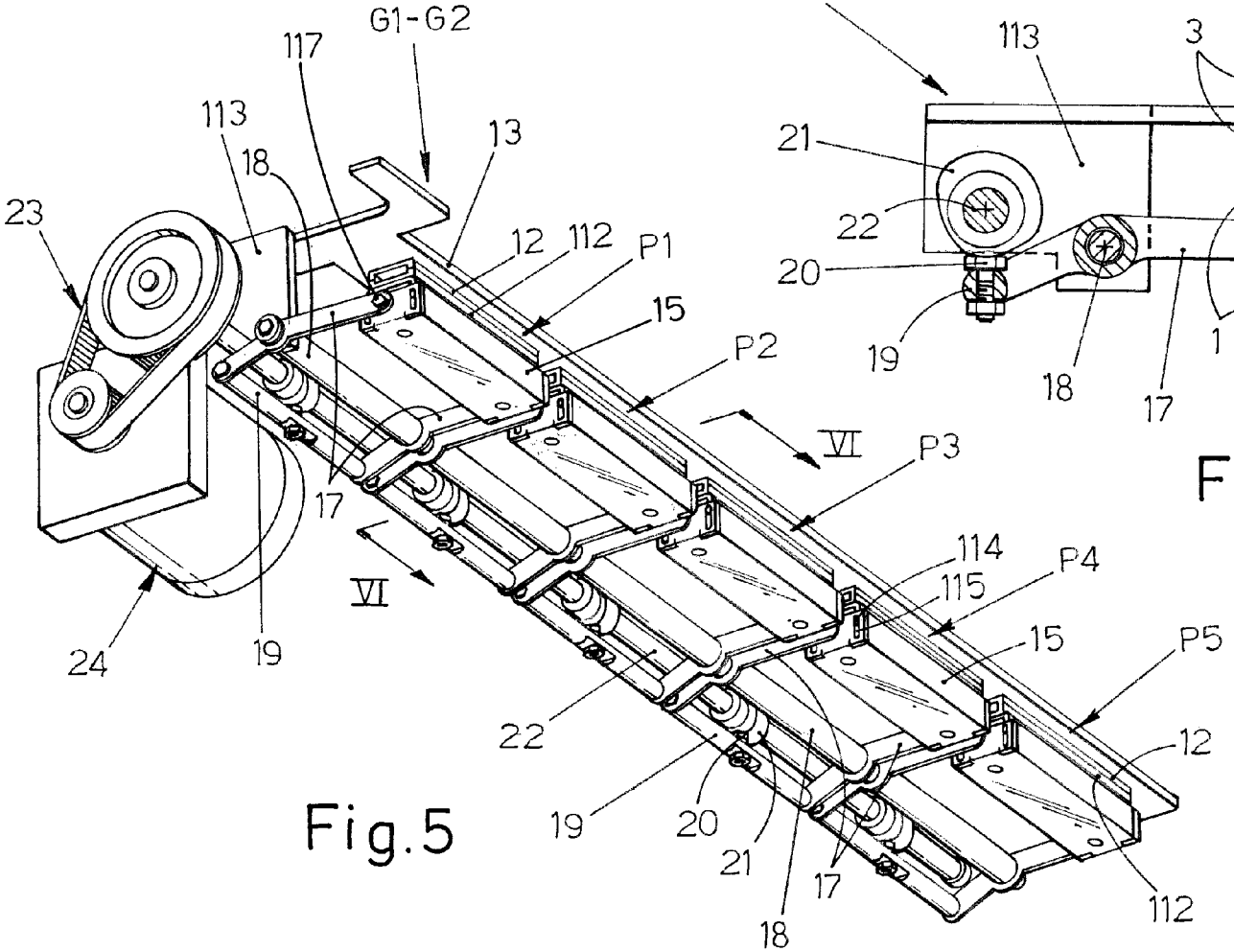
FIG. 5 is a perspective view from below of one of the sets of clamps that acts on a pair of superposed belts shown in the previous figures.

Referring now to the details of FIGS. 5 and 6, it can be seen that the straight lower section of the upper belt 3 runs in a plurality of grooved guides 12 made of a material with a low friction coefficient, for example polyzene, aligned and fixed to the underside of a plate 13 secured to the frame supporting the set G1 or G2. In the example in question, there are five guides 12, one after the other with an appropriate distance between them, but it is understood that these guides may be in any number or may be replaced with a single continuous guide. Opposite the guides 12, from which the belt 3 duly protrudes so as to cooperate with the upper section of the lower belt 1, are similar guides 112, also made of polyzene, in which said upper section of the belt 1 runs and from which it partly protrudes, in such a way that the film F placed between the belts 1 and 3 can be conveyed by the latter without interfering with said running guides 12 and 112. The lower guides 112 are secured to the sprung jaws of corresponding clamps P1-P5 arranged in single file and controlled by means that can modify the thrust thereof towards the belt 1 and therefore vary the pressure with which the lower belt 1 is pushed against the upper belt 3. Each clamp P1 to P5 comprises a jaw 14, for example made of metal, with an upside-down U profile, contained and guided within a box-like body 15, also made of metal, with, on the end walls thereof, pairs of vertical slots 115 in which corresponding end projections 114 of said jaws 14 are guided and slide, said jaws being pushed upwards by springs 16 with the appropriate properties, suitably located and centred between the parts 14 and 15 in question. Each jaw-holder 15 is supported, with the possibility of oscillation about its own longitudinal axis, by the end pins 117 (FIG. 5) of a pair of parallel levers 17 that pivot on a common support shaft 18 and are connected at the other end by means of a crossbar 19 which, in the middle, bears an adjustable tappet 20 made of a material with a low friction coefficient, for example brass, that interacts with a cam 21 also made of a material with a low friction coefficient, for example a suitable plastic, fitted on a common drive shaft 22 supported, with the possibility of rotation, for example by an extension of the same projecting part 113 that holds said pivot shaft 18. One end of the shaft 22 with the cams 21 is connected by means of a positive transmission 23 to a drive unit 24 with a brake, fixed to the same frame as the set G1 or G2, the actuation of which may be controlled electronically via any suitable type of encoder 25, it being possible for this movable piece of equipment to be secured to the end of the shaft 22 opposite the end bearing the drive unit 23, 24 (FIG. 4). As can be seen from FIG. 6, when the cam 21 is rotated, the belt 1 (which, unlike shown in FIG. 6, is still touching the upper belt 3) can be pushed with variable pressure against said belt 3, via corresponding variations in the load of the springs 16. According to the invention, the cams 21 of all the clamps of each set G1 or G2 are the same but are fitted to the rotation shaft 22 with a suitable reciprocal offset, it being envisaged in particular that the cams 21 of the end clamps P1 and P5 will be mutually aligned, the cams 21 of the intermediate clamps P2 and P4 also mutually aligned but offset with respect to the cams of the clamps P1, P5, and the cam of the central clamp P3 in turn offset with respect to the others. During a complete rotation of the shaft 22 bearing the cams 21, the clamps P1-P5 of each set G1 and G2 behave in the following five ways:

- As the film is conveyed and positioned in the packaging station C, all the clamps push the upper section of the belt 1 with moderate force, so that the belts 1 and 3 convey the sheet of packaging film F correctly from said belts to the centre of the station C, above the product to be packaged;
- Once the film has been supplied to and positioned in the station C, all the clamps P1-P5 are pushed to the maximum as the set of belts G2 are usually then moved away from the set G1 so as to prestretch the sheet of film transversely as necessary, for which purpose the longitudinal sides of said sheet must be held firmly by the belts 1 and 3;
- As the packaging cycle begins, while the movable set of belts G2 can move closer to the static set G1 as necessary, depending on the type of product to be packaged, the outer clamps P1 and P5 slacken the pushing force to release the portions of film held between the sections of belts 1 and 3 controlled by said outer clamps, while all the other clamps (P2-P4) remain pushed to the maximum to keep hold of the portion of film controlled by them;
- Half-way through the packaging cycle, the intermediate clamps P2 and P4 also move into the position where they release the film, while the central clamp P3 stays in the raised holding position;
- At the end of the packaging cycle, all the clamps P1-P5 are in the position in which the belts 1 and 3 ungrip and release the film.

When a sheet of film F is in position in the packaging station C, a product to be packaged is positioned underneath said sheet by known means, the size and weight of said product having been measured also by known means, so that the various steps of packaging and labeling can be tailored to these parameters. The product sits on a lift of variable geometry, also known and therefore not shown, which is commanded during lifting to take the tray with the product from the internal supply belts and lift it until it reaches the waiting prestretched sheet of film, lifting coming to an end when the lower plane of the tray has slightly exceeded the ideal plane of the belts 1, 3 with the relative clamps P1-P5 in the closed position. At this level, the film is stretched over the upper surface of the product and, if said product sticks out of the tray, the film substantially hugs the shape of it.

Once the product has been lifted, the rear folder 26 (of known type, FIG. 1) is activated and advances horizontally under said product in the direction marked by the arrow Y and, in due course, according to the programmed procedure, the lateral folders (also known) 27, 127 are moved closer together, with a horizontal and symmetrical movement under said tray containing the product, and as these folders operate to fold, in a known manner, the film under the tray containing the product, the clamps P1-P5 are opened as programmed, from the outside towards the centre, the clamps of the static set G1 opening with an appropriate time lag with respect to the clamps of the movable set G2, so as to keep the film stretched as it is about to be folded and adhered by suitably overlapping the edges on the underside of the tray containing the product. Next, the command is issued for the rear pusher 28 (also known) to move in the direction of the arrow Y of FIG. 1, said pusher pushing the tray containing the product so that it exits above the fixed folder 29, while all the clamps P1-P5 of the static set G1 are opened in due course so that the last edge of the film can also be stretched over the bottom of the tray and under the other edges previously stretched, and then the tray containing the product thus packaged and pushed downwards by a known presser, usually with rolling action (not shown), is transferred onto a welding conveyor belt 30 that also runs in the direction Y, at the same speed as the pusher 28 which, once the product has been discharged and transferred, returns to the rest position together with all the other components of the machine, ready to repeat a new cycle of operation. While it is on the conveyor 30, the edges of the packaging film, stretched and overlapped over the bottom of the tray containing the product, are welded together to secure the packaging by said film. During this pause, labels may be applied to the packaged product by appropriate means, in a programmable position. The packaged tray stays on the conveyor 30 for as long as required for the edges of the film to be welded, before being discharged onto co-planar downstream rollers 31 by said conveyor 30 which is normally activated in phase with the operational path of the pusher 28, as the latter completes the packaging of a subsequent product. The rollers 31 are associated with up-and-down means (not shown), such that after a packaged product is received and discharged by the welding conveyor, said rollers 31 lower to place the product on the underlying parallel belts of a motorized conveyor 32 that offloads said product onto means for carrying it away in the direction XR or XL, which is at 90° to the direction of supply of the trays containing the product to be packaged, first on the weighing conveyor and then on the abovementioned lift, all these means being known and therefore not shown.

FIG. 1 shows how the cyclical movement of the welding conveyor 30 can be taken from the belt 33 activated alternately by the drive unit 133, to which belt the pusher 28, sliding on guide and slide means 228 parallel to the direction Y, is connected via a projecting part 128. The drive transmission 34 that takes the rotation from an end pulley 233 of said belt 33 and drives a roller 130 around which the welding conveyor 30 runs, comprises a freewheel or equivalent means, whereby the upper section of said conveyor 30 is driven in the direction Y when the pusher 28 is driven in the same direction, while when the pusher stops, the conveyor 30 disengages from said kinematic chain and remains stationary.

The invention claimed is:

1. A machine having a packaging station at which trays having products therein are sealed with a heat-weldable stretch film, comprising;

opposed parallel sets of belts, which belts are mounted to move in synchronism with each other transverse to the direction of movement of the trays along the packaging station, each set of belts having an upper belt which has a lower run and which runs adjacent an upper run of a lower belt, said adjacent runs constructed to move in the same direction as each other at the same linear speed, an end of the adjacent runs of each set of opposed belts constructed to receive a sheet of film which is fed along the adjacent runs into the packaging station, a plurality of jaws arranged on the side of each opposed set of parallel belts, which side faces towards the other of the opposed sets of belts, each set of jaws positioned to receive both of said adjacent runs, with an edge of the film between them, the opposed sets of belts being movable relatively towards and away from each other while remaining parallel to each other, such that the jaws can hold films of different widths and such that when the film is held by the jaws on both sides, relative movement of the opposed sets of belts away from and towards each other will stretch and relax the film, respectively, and a clamp connected to each of said jaws, the clamp being spring biased to separate the jaws from each other, and including a power element arranged to exert a selective force to close the jaws onto the film and the adjacent runs, a cam operatively engaging each power element, each cam having an outer profile with varying heights, and movable to place different heights of the profile into operative engagement with its respective power elements such that its closing force is viable, depending on the height of the cam profile operatively engaging its respective power element at any given time.

2. A machine according to claim 1, wherein the profiles of the cams vary among the plurality of cams, such that the force supplied by the cams to close the jaws onto the film is variable, as determined by the requirements of the operation of the packaging station.

3. A machine according to claim 2, including outer clamps located at the ends of a tray, taken in the direction of movement of the film, central clamps near the center of the side of a tray, and intermediate clamps located between the central and outer clamps, and wherein the profiles of the plurality of cams are shaped to act on their respective clamps as follows:

(1) as the film is conveyed and positioned in the packaging station, closing all of the clamps with a moderate force so that the adjacent runs hold and convey the sheet of film correctly, (2) once the film has been positioned in the packaging station, applying a maximum closing force on all of the clamps as the opposing sets of belts are moved relatively away from each other to stretch the film, (3) as a film is applied onto the trays, moving the opposing sets of opposed belts relatively towards each other to slacken the film and reducing the closing force on the outer clamps while maintaining maximum closing force on clamps located between the outer clamps, (4) halfway through the packaging cycle, releasing the closing force on the intermediate clamps, maintaining a closing force on the central clamps, and (5) at the end of the packaging cycle, removing the closing force from all of said clamps to release the film.

4. A machine according to claim 1, wherein each clamp comprises a body with a relatively movable top and bottom, the film and adjacent runs located adjacent the top, the spring bias urging the top and bottom away from each other, and the cams acting to raise the bottom.

5. A machine according to claim 4, wherein each bottom is fixed to a lever, all of which levers are pivotally mounted on a support shaft, and the ends of the levers remote from the clamps engaging a cam, and all of the cams are fixedly mounted on a drive shaft.

6. A machine according to claim 5, wherein the drive shaft is connected to a drive source, and including an encoder which detects the angular position of the drive shaft.

7. A machine according to claim 1, each of the sets of opposed belts including a support plate located between and extending parallel to the upper and lower runs of the upper belt, first grooved guides fixed to the underside of the support plate, the lower run of the upper belt located in said first grooved guides and protruding outwardly from the first grooved guides, and second grooved guides fixed to the tops of the clamps, both grooved guides being of a low friction coefficient material, and the upper run of the lower belt located in said second grooved guides and protruding outwardly therefrom.

8. A machine according to claim 1, wherein one of the sets of opposed belts is fixed relative to a frame and the other set of opposed belts is movable towards and away from the fixed set of opposed belts.

9. A machine according to claim 8, wherein the clamps are constructed such that the clamps of the fixed set of opposed belts are released prior to the release of the clamps of the movable set of opposed belts, the release of both sets being synchronized with actuation of a rear pusher which pushes the closed trays out of the packaging station, a fixed folder which cooperates with the rear pusher and with the release of the clamps, to stretch the film on the trailing edge of the tray, last held by the clamps of the fixed set of opposed belts, over the top of the tray.

10. A machine according to claim 8, including a presser constructed to push the packaged products downwardly, and a welding conveyor downstream from the packaging station and operating at the same speed as the presser.

11. A machine according to claim 10, wherein after a packaged product has been discharged to a transfer station, all components of the packaging machine return to their rest position in preparation for a new cycle.

12. A machine according to claim 11, wherein, while the packaged product is on the welding conveyor, the lower edges of the packaging film are stretched and made to overlay the bottom of the tray.

13. A machine according to claim 12, including a programming structure which determines placement of labels onto a packaged product.

14. A machine according to claim 12, wherein the trays remain on the transfer conveyor for as long as necessary to weld the film to the edges of the tray, after which the trays are carried away perpendicular to the direction of the packaged trays onto the welding station.

15. A machine according to claim 14, wherein the cyclical movements of the welding conveyor are caused by a transmission which drives the rear pusher and wherein the transmission includes a freewheel such that the upper section of the conveyer is driven simultaneously in the same direction and at the same speed as the pusher during an active travel of the pusher, wherein when the pusher disengages from its drive, it remains stationary during the return travel of the pusher to its rest position.

* * * * *